US010813172B2

(12) United States Patent
Blum

(10) Patent No.: US 10,813,172 B2
(45) Date of Patent: Oct. 20, 2020

(54) COOKTOP APPLIANCES AND CONTROL METHODS FOR THE SAME

(71) Applicant: Haier US Appliance Solutions, Inc., Wilmington, DE (US)

(72) Inventor: Michael Blum, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 147 days.

(21) Appl. No.: 15/986,866

(22) Filed: May 23, 2018

(65) Prior Publication Data

US 2019/0364618 A1 Nov. 28, 2019

(51) Int. Cl.
*H05B 1/02* (2006.01)
*F24C 7/08* (2006.01)

(52) U.S. Cl.
CPC ..... *H05B 1/0266* (2013.01); *F24C 7/083* (2013.01)

(58) Field of Classification Search
CPC .. H05B 1/0266; H05B 1/0263; H05B 1/0261; H05B 3/0076; H05B 2213/04; F24C 7/083; F24C 7/043; F24C 7/046; F24C 7/085; F24C 7/088
USPC ..... 219/494, 497, 505, 411–413, 446.1, 219/448.11, 448.14
See application file for complete search history.

(56) References Cited

U.S. PATENT DOCUMENTS

| | | | | |
|---|---|---|---|---|
| 4,913,038 | A * | 4/1990 | Burkett | A47J 37/1266 99/329 R |
| 6,300,606 | B1 * | 10/2001 | Engelmann | H05B 3/746 219/492 |
| 6,350,968 | B1 | 2/2002 | Connolly et al. | |
| 6,403,932 | B1 * | 6/2002 | Nelson | H05B 3/746 219/448.11 |
| 7,105,781 | B2 | 9/2006 | Wilkins et al. | |
| 8,334,487 | B2 | 12/2012 | Ohashi et al. | |
| 9,132,302 | B2 | 9/2015 | Luongo et al. | |
| 9,226,343 | B2 * | 12/2015 | Moon | H05B 6/062 |
| 9,857,082 | B2 * | 1/2018 | McKee | F24C 7/088 |
| 10,260,755 | B2 * | 4/2019 | Bach | F24C 7/087 |
| 10,278,238 | B2 * | 4/2019 | Meng | H05B 1/0266 |

* cited by examiner

*Primary Examiner* — Mark H Paschall
(74) *Attorney, Agent, or Firm* — Dority & Manning, P.A.

(57) ABSTRACT

A cooktop appliance includes an electric heating element positioned at a cooking surface and a controller operably connected to the electric heating element. The controller is configured to generate a temperature setting. The controller is also configured to activate the electric heating element and calculate a projected maximum temperature. The controller is further configured to deactivate the electric heating element when the projected maximum temperature is greater than the temperature setting.

20 Claims, 6 Drawing Sheets

COOKTOP APPLIANCES AND CONTROL METHODS FOR THE SAME

FIELD

The present subject matter relates generally to cooktop appliances, including cooktop appliances configured for precise temperature control.

BACKGROUND

Cooktop appliances generally include heating elements for heating cooking utensils, such as pots, pans and griddles. A user can select a desired heating level, and operation of the heating elements is modified to match the desired heating level. For example, certain cooktop appliances include electric heating elements. During operation, the cooktop appliance operates the electric heating elements at a predetermined power output corresponding to a selected heating level.

Operating the electric heating elements at the predetermined power output corresponding to the selected heating level poses certain challenges. For example, the predetermined power output is only an indirect measurement of the actual cooking temperature. Some cooktop appliances employ a temperature sensor to directly measure the temperature of a cooking utensil and/or articles contained within the cooking utensil. The measured temperature may then be used to adjust the power output above or below the predetermined level in order to achieve a cooking temperature closer to the selected heating level.

However, in certain cooktop appliances, such as radiant cooktop appliances, precise temperature control can be difficult to achieve due to noise, thermal lag or hysteresis, and limitations on the useful life of controls.

Accordingly, a cooktop appliance with features for improved precision in temperature control would be useful.

BRIEF DESCRIPTION OF THE INVENTION

Aspects and advantages of the invention will be set forth in part in the following description, or may be apparent from the description, or may be learned through practice of the invention.

In an exemplary aspect of the present disclosure, a cooktop appliance is provided. The cooktop appliance includes an electric heating element positioned at a cooking surface and a controller operably connected to the electric heating element. The controller is configured to generate a temperature setting. The controller is also configured to activate the electric heating element and calculate a projected maximum temperature. The controller is further configured to deactivate the electric heating element when the projected maximum temperature is greater than the temperature setting.

In another exemplary aspect of the present disclosure, a method of operating a cooktop appliance is provided. The cooktop appliance includes an electric heating element positioned at a cooking surface of the cooktop appliance. The method includes generating a temperature setting. The method also includes activating the electric heating element and calculating a projected maximum temperature. The method further includes deactivating the electric heating element when the projected maximum temperature is greater than the temperature setting.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
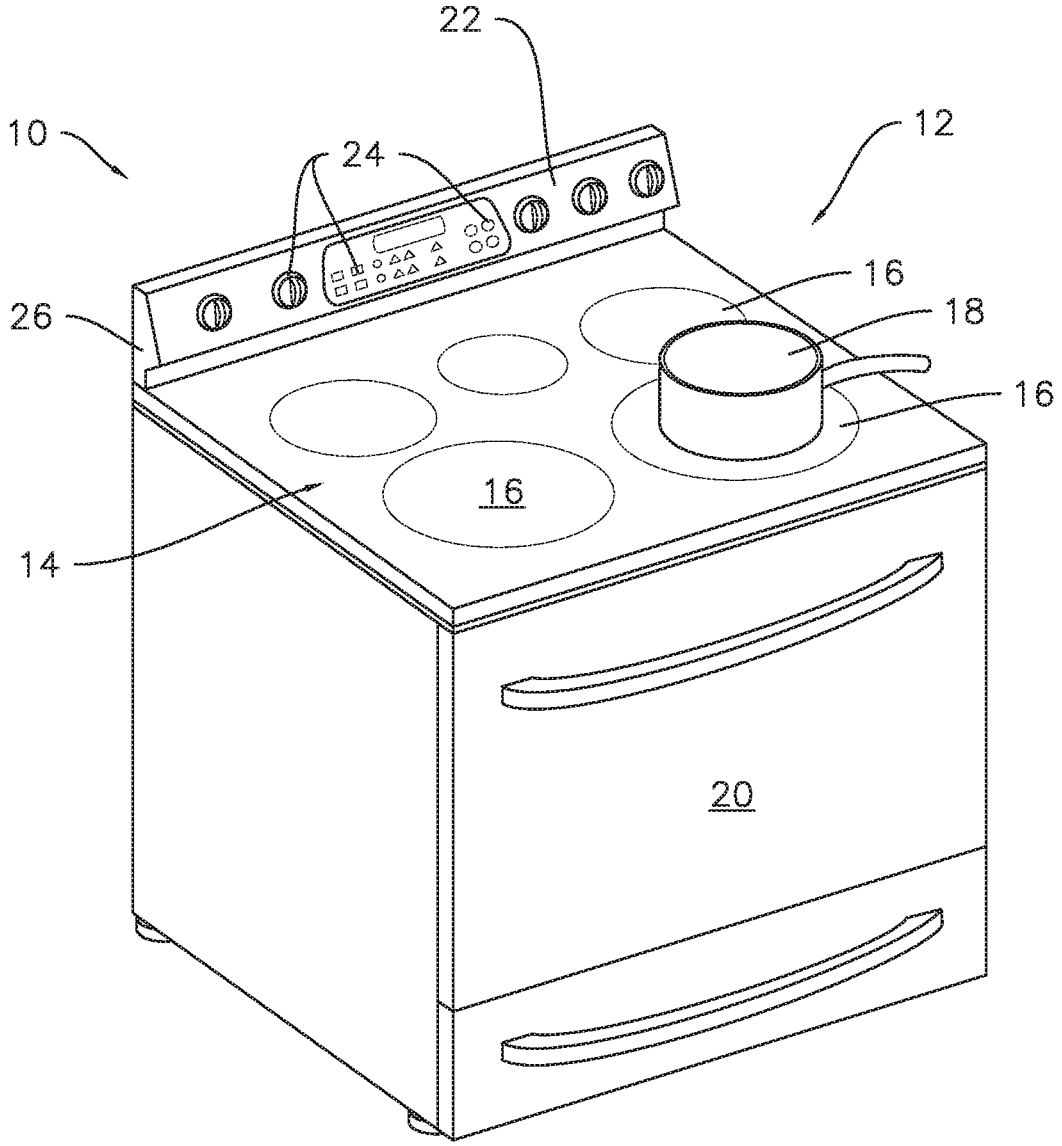
FIG. 1 provides a perspective view of a range having a cooktop appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "generally," or "about" include values within ten percent greater or less than the stated value.

FIG. 1 provides a perspective view of a range appliance, or range 10, including a cooktop 12. Range 10 is provided by way of example only and is not intended to limit the present subject matter to the arrangement shown in FIG. 1. Thus, the present subject matter may be used with other range 10 and/or cooktop 12 configurations, e.g., double oven range appliances, standalone cooktop appliances, cooktop appliances without an oven, etc.

A cooking surface 14 of cooktop 12 includes a plurality of heating elements 16. For the embodiment depicted, the cooktop 12 includes five heating elements 16 spaced along cooking surface 14. The heating elements 16 are generally electric heating elements and are positioned at, e.g., on or proximate to, the cooking surface 14. In certain exemplary embodiments, cooktop 12 may be a radiant cooktop with resistive heating elements or coils mounted below cooking surface 14. However, in other embodiments, the cooktop appliance 12 may include any other suitable shape, configuration, and/or number of heating elements 16, for example, the cooktop appliance 12 may be an open coil cooktop with the heating elements 16 positioned on or above surface 14. Additionally, in other embodiments, the cooktop appliance 12 may include any other suitable type of heating element 16, such as an induction heating element. Each of the heating elements 16 may be the same type of heating element 16, or cooktop appliance 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber (not shown) of range appliance 10, e.g., for cooking or baking of food items therein. A control panel 22 having controls 24 permits a user to make selections for cooking of food items. Although shown on a backsplash or back panel 26 of range appliance 10, control panel 22 may be positioned in any suitable location. Controls 24 may include buttons, knobs, and the like, as well as combinations thereof, and/or controls 24 may be implemented on a remote user interface device such as a smartphone, as described below. As an example, a user may manipulate one or more controls 24 to select a temperature and/or a heat or power output for each heating element 16. The selected temperature or heat output of heating element 16 affects the heat transferred to cooking utensil 18 placed on heating element 16.

As will be discussed in greater detail below, the cooktop appliance 12 includes a control system 50 (FIG. 3) for controlling one or more of the plurality of heating elements 16. Specifically, the control system 50 may include a controller 52 (FIGS. 2 and 3) operably connected to the control panel 22 and controls 24. The controller 52 may be operably connected to each of the plurality of heating elements 16 for controlling a power supply to each of the plurality of heating elements 16 in response to one or more user inputs received through the control panel 22 and controls 24.

Figure 2:
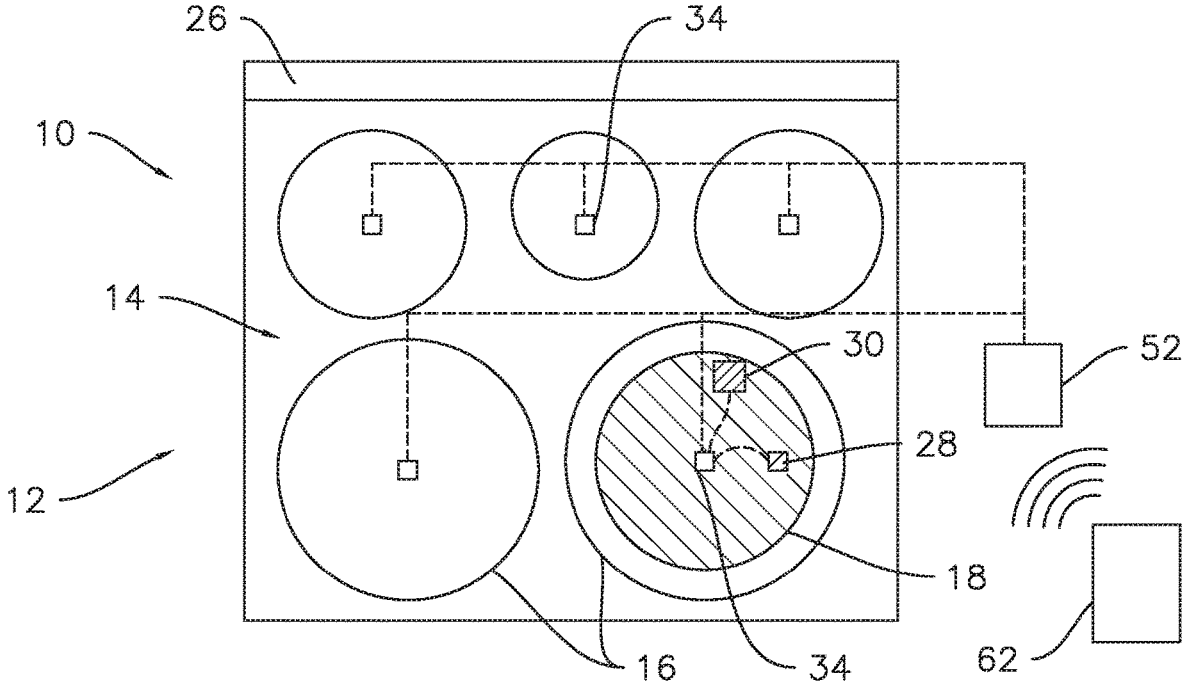
FIG. 2 provides a top, schematic view of the exemplary cooktop appliance of FIG. 1.

Referring now to FIG. 2, a top, schematic view of the cooktop 12 of FIG. 1, or more specifically of the cooking surface 14 of the cooktop 12 of FIG. 1, is provided. As stated, the cooking surface 14 of the cooktop 12 for the embodiment depicted includes five heating elements 16 spaced along the cooking surface 14. A cooking utensil 18, also depicted schematically, is positioned on a first heating element 16 of the plurality of heating elements 16. For the embodiment depicted, a cookware temperature sensor 28 and a food temperature sensor 30 are also associated with the cooking utensil 18.

Figure 3:
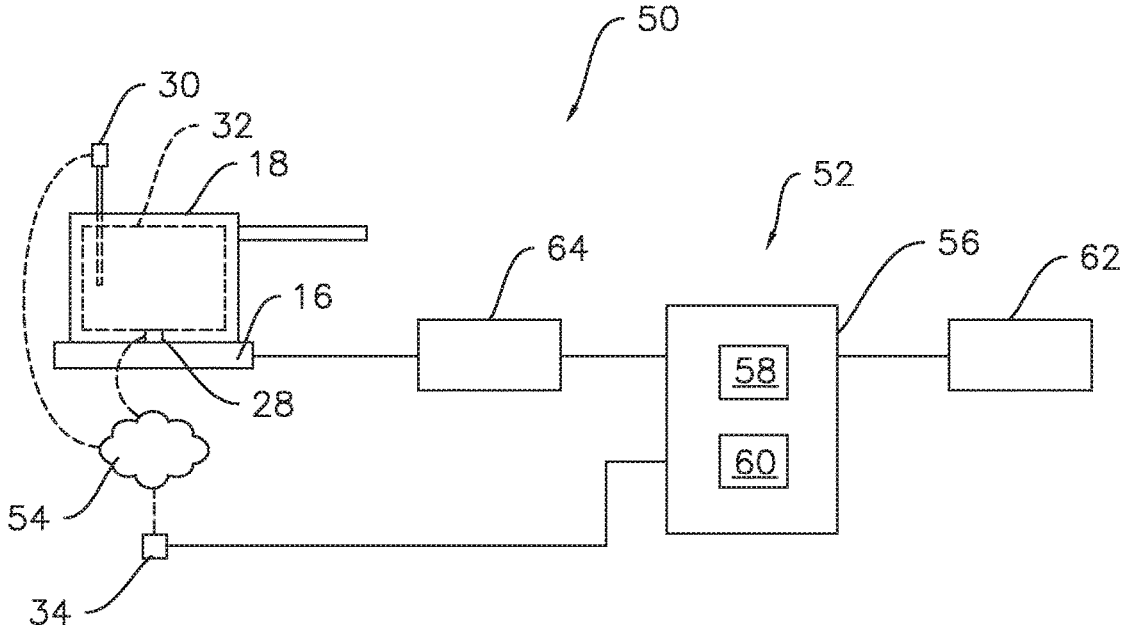
FIG. 3 provides a schematic diagram of a control system as may be used with the exemplary cooktop appliance of FIG. 2.
Figure 4:
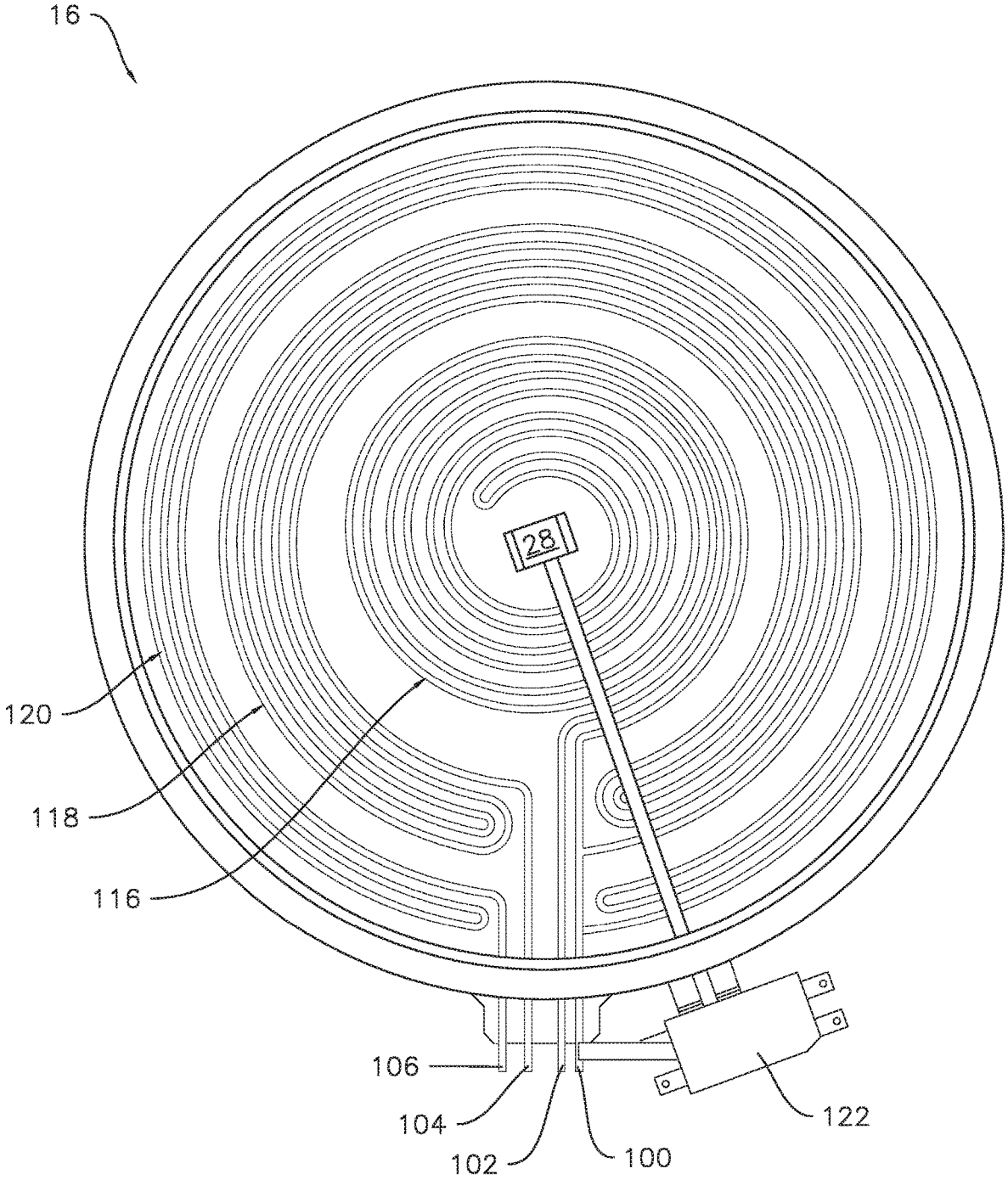
FIG. 4 provides a close up view of an exemplary heating element according to one or more exemplary embodiments of the present subject matter.

In some example embodiments, the cookware temperature sensor 28 may be in contact with, attached to, or integrated into the cooking utensil 18 and configured to sense a temperature of, e.g., a bottom surface of the cooking utensil 18 or bottom wall of the cooking utensil 18. For example, the cookware temperature sensor 28 may be embedded within the bottom wall of the cooking utensil 18 as illustrated in FIG. 3. Alternatively, however, the cookware temperature sensor 28 may be attached to or integrated within the cooking surface 14 of the cooktop appliance 12. For example, the cookware temperature sensor 28 may be integrated into one or more of the heating elements 16, as illustrated in FIG. 4. With such an exemplary embodiment, the cookware temperature sensor 28 may be configured to physically contact the bottom surface of a bottom wall of the cooking utensil 18 when the cooking utensil 18 is placed on the heating element 16 of the cooking surface 14. Alternatively, cookware temperature sensor 28 may be positioned proximate to the bottom surface or bottom wall of the cooking utensil 18 when the cooking utensil 18 is placed on the heating element 16 of the cooking surface 14.

Additionally, the food temperature sensor 30 may be positioned at any suitable location to sense a temperature of one or more food items 32 (see FIG. 3) positioned within the cooking utensil 18. For example, the food temperature sensor 30 may be a probe type temperature sensor configured to be inserted into one or more food items 32. Alternatively, however, the food temperature sensor 30 may be configured to determine a temperature of one or more food items positioned within the cooking utensil 18 in any other suitable manner.

In certain exemplary embodiments, one or both of the cookware temperature sensor 28 and the food temperature sensor 30 may utilize any suitable technology for sensing/determining a temperature of the cooking utensil 18 and/or food items 32 positioned in the cooking utensil 18. The cookware temperature sensor 28 and the food temperature sensor 30 may measure a respective temperature by contact and/or non-contact methods. For example, one or both of the cookware temperature sensor 28 and the food temperature sensor 30 may utilize one or more thermocouples, thermistors, optical temperature sensors, infrared temperature sensors, resistance temperature detectors (RTD), etc.

Referring again to FIGS. 2 and 3, the cooktop appliance 12 additionally includes at least one receiver 34. In the illustrated example of FIG. 2, the cooktop appliance 12 includes a plurality of receivers 34, each receiver 34 associated with an individual heating element 16. Each receiver 34 is configured to receive a signal from the food temperature sensor 30 indicative of a temperature of the one or more food items 32 positioned within the cooking utensil 18 and from the cookware temperature sensor 28 indicative of a temperature of the cooking utensil 18 positioned on a respective heating element 16. In other embodiments, a single receiver 34 may be provided and the single receiver 34 may be operatively connected to one or more than one of the sensors. In at least some exemplary embodiments, one or both of the cookware temperature sensor 28 and the food temperature sensor 30 may include wireless transmitting capabilities, or alternatively may be hard-wired to the receiver 34, e.g., through a wired communications bus.

FIG. 3 provides a schematic view of a system for operating a cooktop appliance 12 in accordance with an exemplary embodiment of the present disclosure. Specifically, FIG. 3 provides a schematic view of a heating element 16 of the exemplary cooktop appliance 12 of FIGS. 1 and 2 and an exemplary control system 50.

As stated, the cooktop appliance 12 includes a receiver 34 associated with one or more of the heating elements 16, for example a plurality of receivers 34 each associated with a respective heating element 16. For the embodiment depicted, each receiver 34 is positioned directly below a center portion of a respective heating element 16. Moreover, for the embodiment depicted, each receiver 34 is configured as a wireless receiver 34 configured to receive one or more wireless signals. Specifically, for the exemplary control system 50 depicted, both of the cookware temperature sensor 28 and the food temperature sensor 30 are configured as wireless sensors in wireless communication with the wireless receiver 34 via a wireless communications network 54. In certain exemplary embodiments, the wireless communications network 54 may be a wireless sensor network (such as a Bluetooth communication network), a wireless local area network (WLAN), a point-to point communication networks (such as radio frequency identification (RFID) networks, near field communications networks, etc.), a combination of two or more of the above communications networks, or any suitable wireless communications network or networks.

Referring still to FIG. 3, each receiver 34 associated with a respective heating element 16 is operably connected to a controller 52 of the control system 50. The receivers 34 may be operably connected to the controller 52 via a wired communication bus (as shown), or alternatively through a wireless communication network similar to the exemplary wireless communication network 54 discussed above. The controller 52 may generally include a computing device 56 having one or more processor(s) 58 and associated memory device(s) 60. The computing device 56 may be configured to perform a variety of computer-implemented functions to control the exemplary cooktop appliance 12. The computing device 56 can include a general purpose computer or a special purpose computer, or any other suitable computing device. It should be appreciated, that as used herein, the processor 58 may refer to a controller, a microcontroller, a microcomputer, a programmable logic controller (PLC), an application specific integrated circuit, and other programmable circuits. Additionally, the memory device(s) 60 may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory 60 can store information accessible by processor(s) 58, including instructions that can be executed by processor(s) 58. For example, the instructions can be software or any set of instructions that when executed by the processor(s) 58, cause the processor(s) 58 to perform operations. For the embodiment depicted, the instructions may include a software package configured to operate the system to, e.g., execute the exemplary methods described below.

Referring still to FIG. 3, the control system 50 additionally includes a user interface 62 operably connected to the controller 52. For the embodiment depicted, e.g., in FIG. 3, the user interface 62 is configured in wired communication with the controller 52. However, in other exemplary embodiments, e.g., as shown in FIG. 2, the user interface 62 may additionally or alternatively be wirelessly connected to the controller 52 via one or more suitable wireless communication networks (such as the exemplary wireless communication network 54 described above). In certain exemplary embodiments, user interface 62 may be configured as the control panel 22 and plurality of controls 24 on the cooktop appliance 12 (see FIG. 1). Additionally, or alternatively, the user interface 62 may be configured as an external computing device or remote user interface device, such as a smart phone, tablet, or other device capable of connecting to the controller 52 of the exemplary control system 50. For example, in some embodiments, the remote user interface may be an application or "app" executed by a remote user interface device such as a smart phone or tablet. Signals generated in controller 52 operate the cooktop 12 in response to user input via the user interface 62.

Further, the controller 52 is operably connected to each of the plurality of heating elements 16 for controlling a supply of power to each of the plurality of heating elements 16 in response to one or more user inputs through the user interface 62 (e.g., control panel 22 and controls 24). For example, wherein one or more of the heating elements 16 are configured as electric resistance heaters, the controller 52 may be operably connected to respective relays controlling a supply of power to such electrical resistance heaters. Alternatively, in embodiments wherein one or more of the heating elements 16 are configured as induction heating elements, the controller 52 may be operably connected to respective current control devices.

An exemplary resistance heating element 16 is illustrated in FIG. 4. In the illustrated example embodiment, the heating element 16 comprises a temperature limiter 122 and a plurality of terminals. In particular, the exemplary heating element 16 illustrated in FIG. 4 includes a first terminal 100, a second terminal 102, a third terminal 104, and a fourth terminal 106. As shown, the exemplary heating element 16 includes three rings, e.g., a first ring 116 corresponding to the second terminal 102, a second ring 118 corresponding to the third terminal 104, and a third ring 120 corresponding to the fourth terminal 106. A voltage may be applied across all or a selected one or more of the rings 116, 118, and 120 by connecting a voltage source across the first terminal 100 and one of the second terminal 102, third terminal 104, and fourth terminal 106. In other embodiments, the heating element 16 may include only a single ring and only the first and second terminals 100 and 102.

Figure 5:
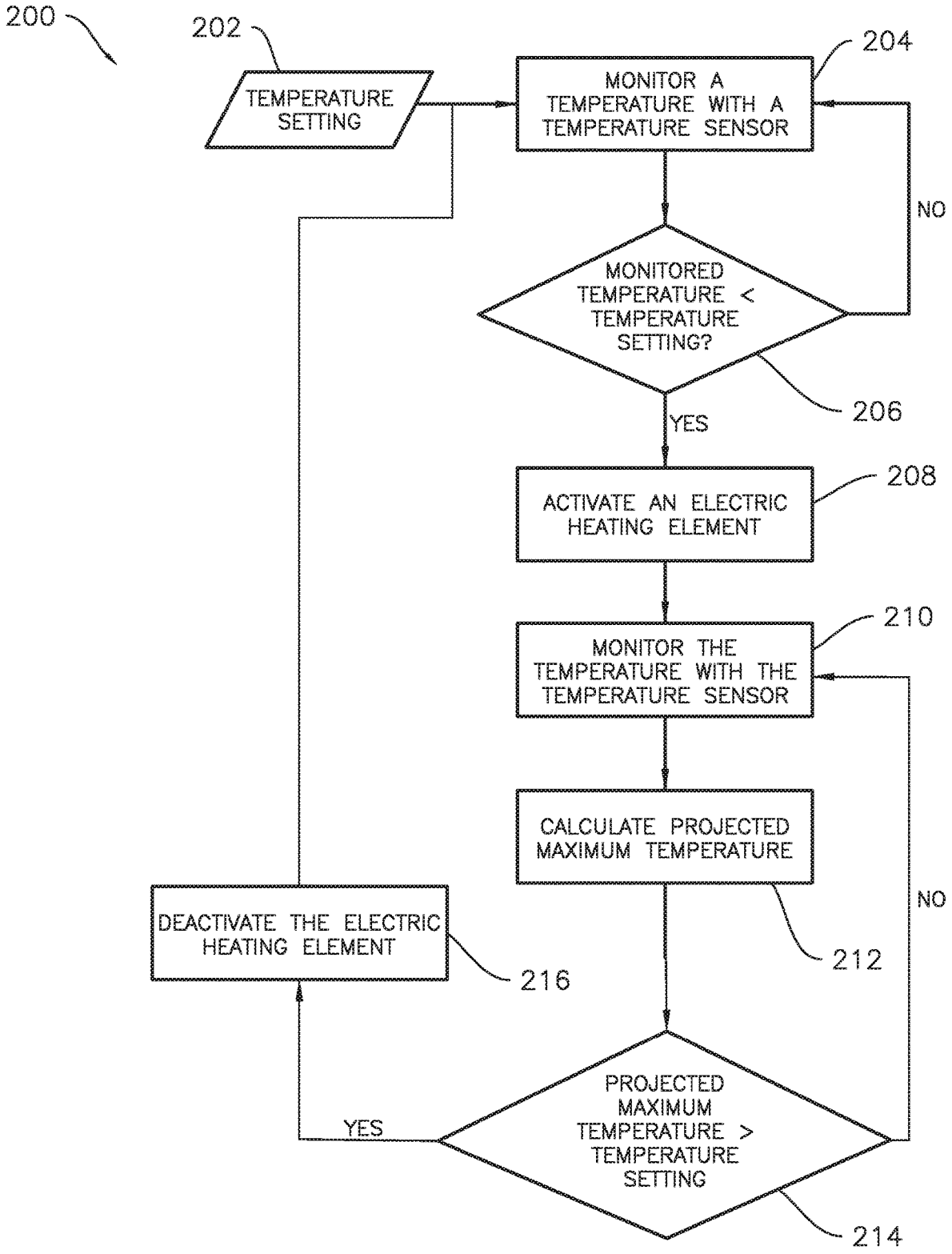
FIG. 5 provides a flowchart illustrating an exemplary operation of a cooktop appliance according to one or more exemplary embodiments of the present subject matter.

FIG. 5 illustrates an exemplary method 200 of operating a cooktop appliance, such as the exemplary cooktop 12. In some embodiments, the controller 52 may be configured to perform some or all of the steps of method 200. The method 200 may include a step 202 of generating or receiving a temperature setting. For example, the cooktop appliance 12 and/or a controller 52 thereof may be configured to generate a temperature setting, e.g., the temperature setting may be generated by the controller 52 in response to a user input received via the user interface 62 (FIG. 3). The controller 52 may be further configured for monitoring a temperature with a temperature sensor, e.g., at step 204. The temperature may be monitored with one or both of the cookware temperature sensor 28 and the food temperature sensor 30, e.g., temperature values may be continuously measured by the temperature sensor(s) 28 and/or 30 over time during the operation of the cooktop 12. Thus, it should be understood that "monitored," "monitoring," or other cognates thereof as used herein include continuous or repeated measuring or sampling of data, e.g., temperature, over a period of time. Further, in various embodiments, the temperature sensor used in the monitoring steps, e.g., step 204, may be one or both of the cookware temperature sensor 28 and the food temperature sensor 30, and the monitored temperature may be one or both of a temperature of cooking utensil 18 and a temperature of food item 32.

The method 200 may also include determining, at step 206, whether the monitored temperature is less than the temperature setting. When the monitored temperature is greater than the threshold temperature, e.g., when the determination at step 206 is false, the method 200 returns to step 204 and continues to monitor the temperature. When the monitored temperature is less than the temperature setting, the method 200 proceeds to step 208 of activating the electric heating element. The method 200 is a bang bang control method, such that the electric heating element is either active or inactive, e.g., either ON or OFF without any intermediate steps or settings. That is, according to method 200 the electric heating element is either operating at full power, e.g., one hundred percent (100%) power, or not operating at all, e.g., at zero (0) power. As such, method 200 may advantageously be implemented with relatively simple and inexpensive power control devices, e.g., a single-pole, single-throw relay, as opposed to, for example, a triode for alternating current (TRIAC). Additionally, the proposed modified bang bang control method allows for fewer relay cycles when compared to other closed-loop control methods, e.g., proportional-integral-derivative (PID) control, thus increasing the life of the relays.

After activating the electric heating element, the method 200 may include monitoring the temperature, e.g., as illustrated at step 210 in FIG. 5. As described above, the monitored temperature may be any one or more of a cookware temperature, a food temperature, and/or a temperature of the cooking surface 14.

As shown at step 212, the method 200 may also include calculating a projected maximum temperature. The projected maximum temperature accounts for thermal lag or hysteresis, e.g., a continued increase of the temperature of the cooking utensil and food items therein even after deactivating the heating element. The projected maximum temperature may be calculated using a predefined parameter estimating regression equation. The projected maximum temperature may be calculated based on any one or more of several data, such as a current temperature, the rate of change of the temperature, the time the heating element has been on, and/or the element off time since the previous heating cycle. The temperature data used to calculate the projected maximum temperature may include, for example and without limitation, a current temperature value and/or a rate of change of a temperature value. Possible temperature values which may be used include but are not limited to a temperature of the cooking utensil, a food temperature, and/or a temperature of the cooking surface 14.

Based on the projected maximum temperature, the method 200 may determine whether to keep the heating element on and continue to monitor the temperature or to deactivate the heating element. For example, a determination may be made at 214 as to whether the projected maximum temperature exceeds, e.g., is greater than, the temperature setting. If the determination is no, the method 200 may return to step 210 and continue to monitor the temperature. If the determination is yes, e.g., when the calculated maximum temperature indicates that the temperature will overshoot the temperature setting, then the method 200 may deactivate the heating element, e.g., as illustrated at step 216 in FIG. 5.

After deactivating the heating element at step 216, the method 200 may return to step 204 and monitor the temperature. In some embodiments, a time delay may be built into the method 200 between deactivating the heating element at step 216 and returning to step 204 such that the heating element is not reactivated at step 208 in a subsequent iteration too quickly after deactivating the heating element at step 216. In some embodiments, multiple distinct temperature settings may be used. For example, the monitored temperature may be compared to a first temperature setting, which may be the user-input temperature setting or a temperature setting directly derived from a user input value, at step 206 and the projected maximum temperature may be compared to a second temperature setting, e.g., an element off temperature setting, at step 214.

Figure 6:
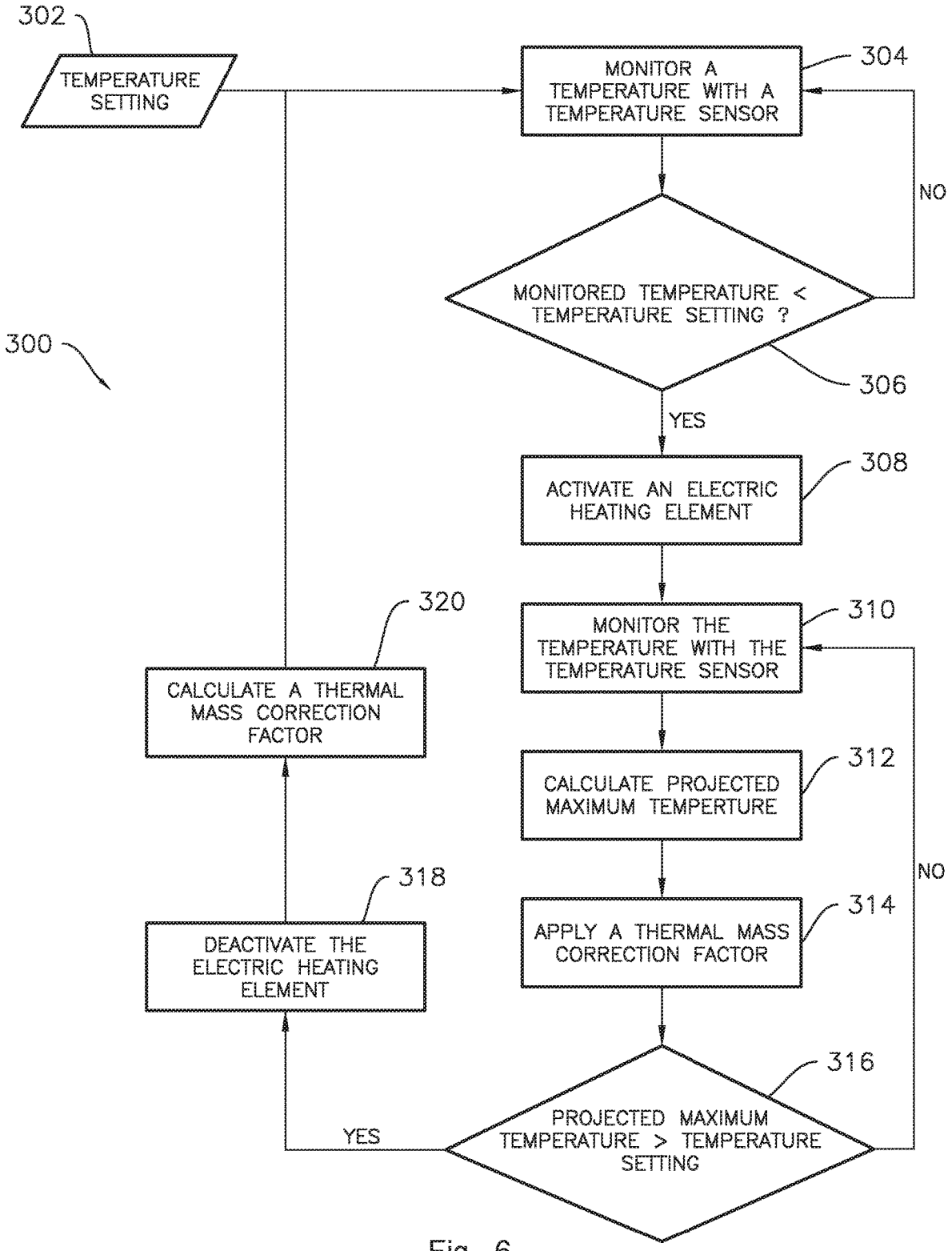
FIG. 6 provides a flowchart illustrating an exemplary operation of a cooktop appliance according to one or more additional exemplary embodiments of the present subject matter.

In various embodiments, bang bang control methods of the present subject matter may include a thermal mass correction factor. For example, the thermal mass correction factor may be one of the variables included in the predefined parameter estimating regression equation used to calculate the projected maximum temperature in step 212 of method 200. In another example embodiment, as illustrated in FIG. 6, a method 300 may include a separate calculation for the thermal mass correction factor, which is then combined with the projected maximum temperature. Steps 302, 304, 306, 308, 310, and 312 of the exemplary method 300 are generally the same as the corresponding steps 202 through 212 of the method 200 illustrated in FIG. 5. At step 314, the method 300 include applying a thermal mass correction factor to the projected maximum temperature. In an initial iteration, e.g., when the heating element is first activated in a given cooking operation, the method 300 may omit applying a thermal mass or may include applying a thermal mass correction factor such that the projected maximum temperature is unchanged, e.g., adding or subtracting zero or multiplying by one. The method 300 may then proceed to a determining step at 316, similar to step 214 of the method 200.

After deactivating the element at step 318 when the projected maximum temperature is greater than the temperature setting, the method 300 may include calculating a thermal mass correction factor at step 320, which is then applied in a subsequent iteration at step 314. The thermal mass correction factor may be calculated in several different manners. In one example, the rate of change of a monitored temperature, e.g., the cookware temperature and/or food temperature, can be compared to that of a known load. The differences or ratio in the rate of changes between the known load and measured temperature of the cookware may be used to estimate the thermal load of the system. In yet another embodiment, a correction factor based on the projection error, e.g., the difference or percent difference between the calculated projected maximum temperature and the actual maximum temperature, may be used as the thermal mass correction factor. The actual maximum temperature may be, e.g., determined or measured at step 310 or at step 304. Additionally, the running average or a weighted average of said correction factors may be used.

Figure 7:
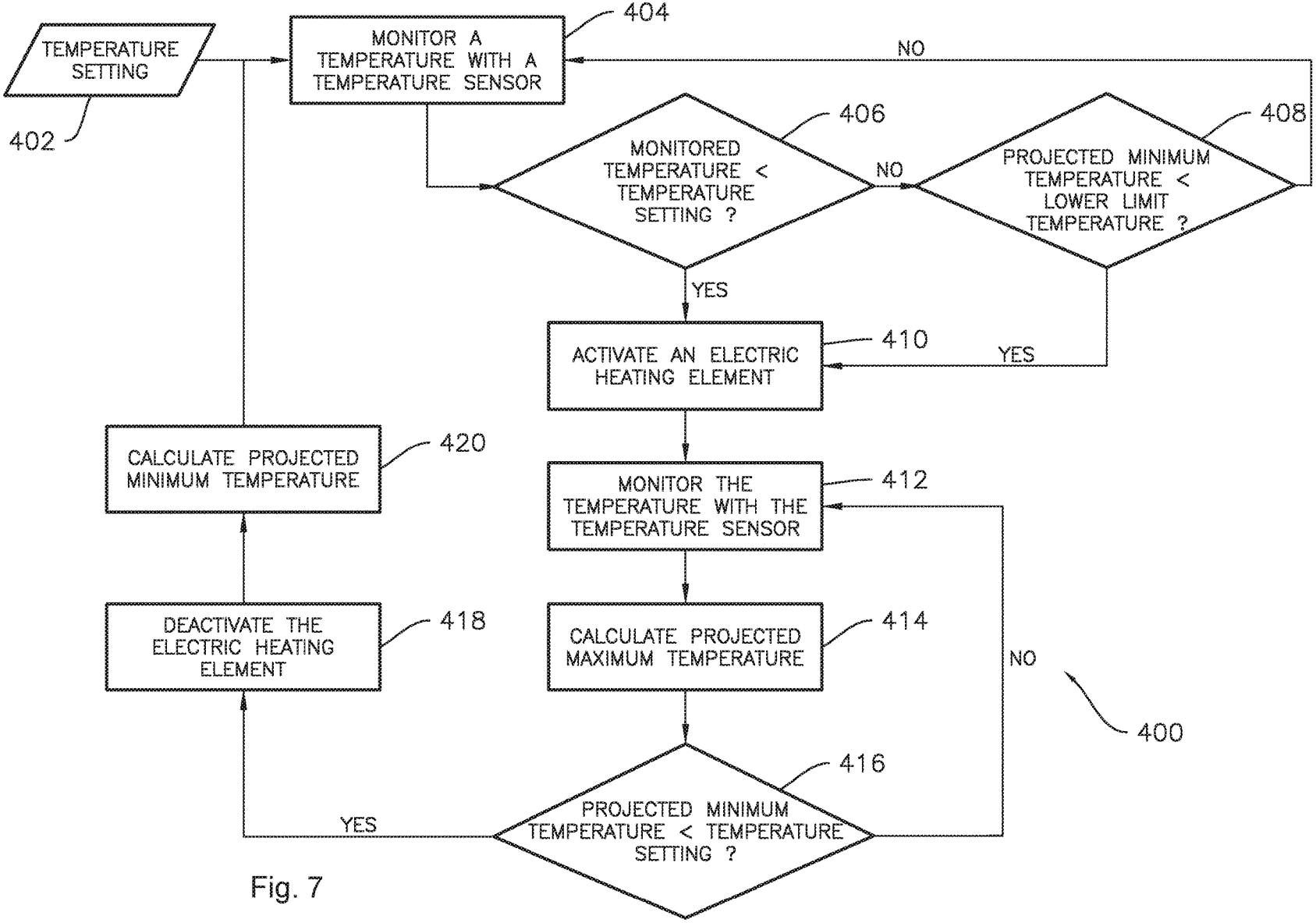
FIG. 7 provides a flowchart illustrating an exemplary operation of a cooktop appliance according to one or more additional exemplary embodiments of the present subject matter.

As illustrated in FIG. 7, additional embodiments of the present bang bang control method may include calculating a projected minimum temperature to prevent or minimize the food items getting too cold. In the example method 400 illustrated by FIG. 7, a temperature setting is generated at step 402 and a temperature is monitored with a temperature sensor at step 404. The method 400 may also include determining, at step 406, whether the monitored temperature is less than the temperature setting. The temperature setting of step 406 may be a first temperature setting, e.g., an upper threshold temperature which is less than the desired temperature or set point temperature from the user input. The upper threshold temperature may be less than the set point temperature to avoid or minimize overshooting the set point temperature. When the monitored temperature is less than the temperature setting, e.g., the upper threshold temperature, the method 400 proceeds to step 410 of activating the electric heating element, similar to steps 208 and 308 of the respective methods 200 and 300 described above. When the monitored temperature is greater than the upper threshold temperature, e.g., when the determination at step 406 is negative, the method 400 includes a step 408 of determining whether the projected minimum temperature is less than a lower limit temperature setting. When the determination at step 408 is yes, the method 400 proceeds to step 410. When the projected minimum temperature is not less than the lower limit temperature, the method 400 returns to step 404 and continues to monitor the temperature.

After activating the heating element at step 410, the method 400 may include a step 412 of monitoring the temperature and a step 414 of calculating a projected maximum temperature. As described above, the projected maximum temperature may be calculated using a predefined parameter estimating regression equation. Based on the projected maximum temperature, the method 400 may determine at step 416 whether to keep the heating element on and continue to monitor the temperature (e.g., return to step 412) or to deactivate the heating element at step 418.

As mentioned above, the method 400 may include calculating a projected minimum temperature at step 420. The projected minimum temperature is an estimate of the minimum temperature that the pan will reach if the heating element is turned on at that instant. The projected minimum temperature may be calculated using a predefined parameter estimating regression equation, similar to the projected maximum temperature described above. Such a regression equation is not limited to, but may use any combination or product of the following process variables: the current temperature (e.g., cookware temperature, cooking surface temperature, and/or food temperature), the rate of change of the temperature, the time the element has been off, and/or the element on time during the previous heating cycle. The projected minimum temperature calculated in step 420 may be applied in a subsequent iteration of the method 400, e.g., in step 408.

As mentioned above, features illustrated or described as part of one embodiment can be used with another embodiment to yield a still further embodiment. For example, the method 200 may also include one or both of the thermal mass correction factor described with respect to method 300 and the projected minimum temperature described with respect to method 400.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

an electric heating element positioned at a cooking surface of the cooktop appliance; and a controller operably connected to the electric heating element, the controller configured to:

generate a temperature setting of the electric heating element;

activate the electric heating element;

calculate a projected maximum temperature that the electric heating element will reach after the electric heating element is deactivated; and deactivate the electric heating element when the projected maximum temperature is greater than the temperature setting, wherein the controller is configured to calculate the projected maximum temperature based on a current temperature, a rate of change in a monitored temperature, and an on duration of the electric heating element.

2. The cooktop appliance of claim 1, wherein the electric heating element is activated by a single-throw relay.

3. The cooktop appliance of claim 1, wherein the controller is further configured to monitor a temperature with a temperature sensor after deactivating the electric heating element.

4. The cooktop appliance of claim 3, wherein the controller is further configured to calculate a projected minimum temperature after deactivating the electric heating element and to reactivate the electric heating element when the projected minimum temperature is less than a lower limit temperature.

5. The cooktop appliance of claim 3, wherein the monitored temperature is a temperature of a cooking utensil.

6. The cooktop appliance of claim 3, wherein the monitored temperature is a temperature of the cooking surface.

7. The cooktop appliance of claim 1, wherein the controller is further configured to calculate a projection error based on a difference between the projected maximum temperature and a measured maximum temperature.

8. The cooktop appliance of claim 1, wherein the controller is further configured to apply a thermal mass correction factor to the projected maximum temperature.

9. The cooktop appliance of claim 8, wherein the thermal mass correction factor is based on a rate of change of a monitored temperature.

10. The cooktop appliance of claim 8, wherein the controller is further configured to calculate a projection error based on a difference between the projected maximum temperature and a measured maximum temperature, and wherein the thermal mass correction factor is based on the projection error.

11. A method of operating a cooktop appliance having an electric heating element positioned at a cooking surface of the cooktop appliance and a user interface operably connected to a controller and configured to transmit a user input to the controller, the method comprising:

generating a temperature setting of the electric heating element in response to a signal from the user interface;

activating the electric heating element;

calculating a projected maximum temperature that the electric heating element will reach after the electric heating element is deactivated; and deactivating the electric heating element when the projected maximum temperature is greater than the temperature setting.

12. The method of claim 11, wherein the projected maximum temperature is calculated based on a current temperature, a rate of change in a monitored temperature, and an off duration of the electric heating element.

13. The method of claim 11, further comprising monitoring a temperature with a temperature sensor after deactivating the electric heating element.

14. The method of claim 13, further comprising calculating a projected minimum temperature after deactivating the electric heating element and reactivating the electric heating element when the projected minimum temperature is less than a lower limit temperature.

15. The method of claim 13, wherein the monitored temperature is a temperature of a cooking utensil.

16. The method of claim 13, wherein the monitored temperature is a temperature of the cooking surface.

17. The method of claim 11, further comprising calculating a projection error based on a difference between the projected maximum temperature and a measured maximum temperature.

18. The method of claim 11, further comprising applying a thermal mass correction factor to the projected maximum temperature.

19. The method of claim 18, wherein the thermal mass correction factor is based on a rate of change of a monitored temperature.

20. The method of claim 18, further comprising calculating a projection error based on a difference between the projected maximum temperature and a measured maximum temperature, wherein the thermal mass correction factor is based on the projection error.

* * * * *